United States Patent [19]

Hara

[11] Patent Number: 4,869,368

[45] Date of Patent: Sep. 26, 1989

[54] PROTECTIVE SHEET

[75] Inventor: Yoshio Hara, Kanagawa, Japan

[73] Assignee: Fuji Photo Film Co., Ltd., Ashigara, Japan

[21] Appl. No.: 202,492

[22] Filed: Jun. 7, 1988

[30] Foreign Application Priority Data

Jun. 8, 1987 [JP] Japan ..... 62-141408

[51] Int. Cl.[4] ..... B65D 85/48

[52] U.S. Cl. ..... 206/455; 206/491; 229/40; 229/198.2; 229/198.3

[58] Field of Search ..... 206/316, 424, 425, 455, 206/491, 492; 229/40, 48 R

[56] References Cited

U.S. PATENT DOCUMENTS

| | | | |
|---|---|---|---|
| 2,002,035 | 5/1935 | Liebeskind | 206/455 |
| 3,167,236 | 1/1965 | Scheinman | 229/48 R |
| 3,243,337 | 3/1966 | Haselow et al. | 229/48 R |
| 3,302,851 | 2/1967 | Johnson | 206/424 |
| 3,720,366 | 3/1973 | Martin | 206/424 |
| 4,501,364 | 2/1985 | Lambach | 206/628 |

FOREIGN PATENT DOCUMENTS 40535 9/1979 Japan .

*Primary Examiner*—David T. Fidei

*Attorney, Agent, or Firm*—Burns, Doane, Swecker & Mathis

[57] ABSTRACT

A protective sheet used for packaging photosensitive sheets which comprises a back panel, an upper panel connected with the upper side edge of the back panel and a bottom panel connected with the lower side edge of the back panel, and at least said upper panel or said bottom panel is provided with side flaps joined therebetween to prevent the photosensitive sheets from slipping out.

3 Claims, 3 Drawing Sheets

FIG. 10
PRIOR ART
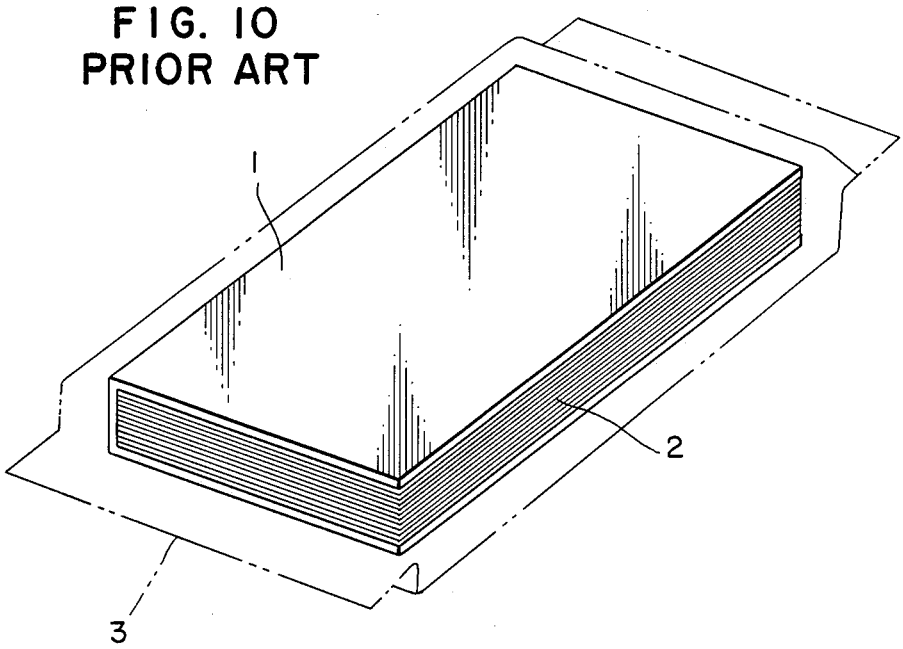
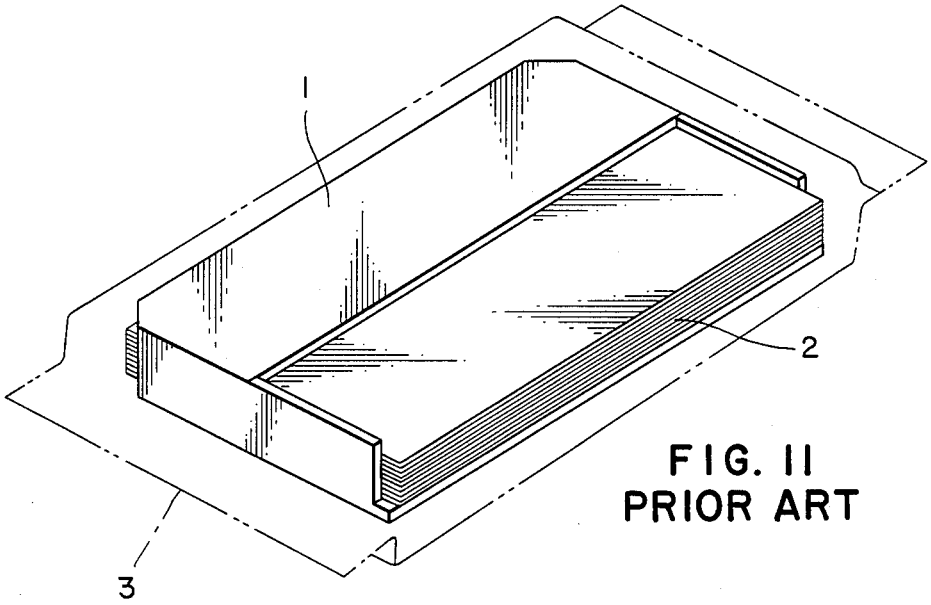
FIG. 11
PRIOR ART

PROTECTIVE SHEET

BACKGROUND OF THE INVENTION

1. Field of the Invention

This invention relates to a protective sheet used for packaging photosensitive sheets, such as X-ray photographic films, lithfilms, cut films, photographic papers, PS sheets and photosensitive resin films.

2. Description of the Prior Art

The photosensitive sheets described above are usually protected by a pad in order to prevent nicking at the time of insertion into the bag in which they are packaged, at the time of transportation and at the time of use in order to protect the sheets from being struck during transportation. A conventional pad 1 was a U-shaped corrugated board, as shown in FIG. 10, and superposed tens to hundreds of photosensitive sheets 2 were placed therein, and inserted into a bag 3 (e.g. Japanese Utility Model KOKAI No. 40535/1981). Another conventional pad 1 was, as shown in FIG. 11, a shallow box-shaped corrugated board where one side and a half upper face were opened. However, the pad of FIG. 10 had the defect that, when the photosensitive sheets were slippery, they slipped out of the pad to cause packaging troubles. The pad of FIG. 11 did not have such a defect. However, construction required time and was expensive.

SUMMARY OF THE INVENTION

An object of the invention is to provide a protective sheet used for packaging photosensitive sheets from which photosensitive sheets do not slip out.

Another object of the invention is to provide a protective sheet used for packaging photosensitive sheets of which construction is easy and which is inexpensive.

The present invention provides a protective sheet used for packaging photosensitive sheets which has achieved such objects, and the protective sheet comprises a back panel, an upper panel connected to the upper side edge of the back panel and a bottom panel connected with the lower side edge of the back panel, and at least said upper panel or said bottom panel is provided with side flaps joined therebetween to prevent the photosensitive sheets from slipping out.

BRIEF DESCRIPTION OF THE DRAWINGS

FIGS. 10 and 11 are perspective views indicating two examples of conventional pads.

DETAILED DESCRIPTION OF THE INVENTION

Figure 1:
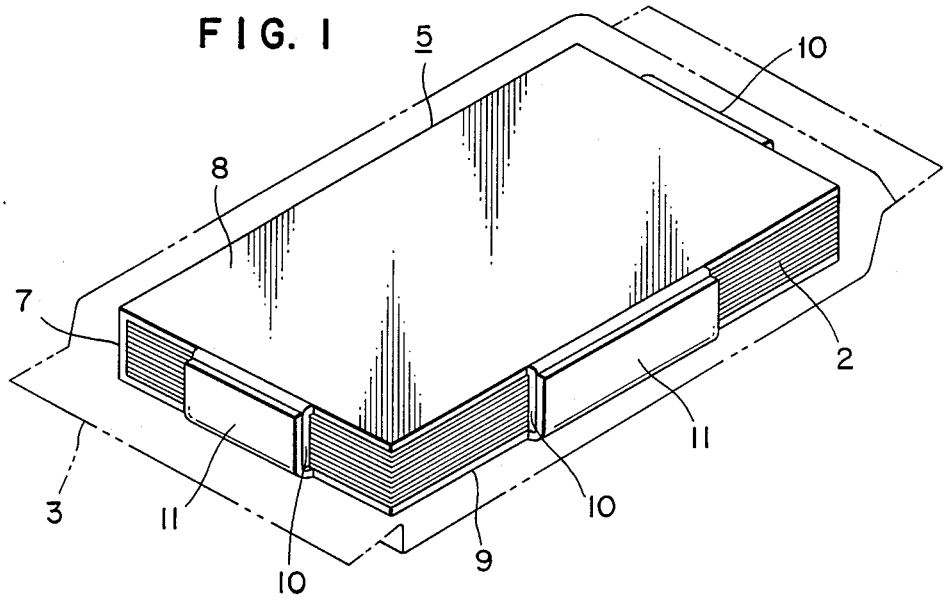
FIG. 1 is a perspective view indicating the constructed state of a protective sheet embodying the invention.

The protective sheet of the invention is composed of three panels with a back panel disposed in the center and an upper panel and a bottom panel disposed on both sides of the back panel. The three panels are formed of one sheet usually square or almost square shaped, and they are divided by a crease line, a perforation line or the like. Each corner of respective panels may be cut off, and respective panels may be provided with opening(s). The shape of the upper panel may be different from the bottom panel. The sizes of the upper panel and the bottom panel are in the range from a half, preferably two thirds of the photosensitive sheets to be packaged to slightly larger than the photosensitive sheet. For example, the upper panel may be a half as shown in FIG. 11.

The side flaps join the upper panel and the bottom panel in three free sides in order to prevent the photosensitive sheets from slipping out. Depending on the embodiment, either or both of the upper panel and the bottom panel are provided with the side flaps. The width of each side flap is sufficient to have the necessary strength for holding the photosensitive sheets. The width may be the same as the length of the side to which the side flap is connected. The number of the side flaps is usually one per each free side, however, it may be two or more. The length of each side flap is necessary to join both free sides of the upper panel and the bottom panel. That is, when a part of the free sides is joined by two side flaps from both sides, it is sufficient that the total length of both side flaps is longer than the total thickness of the photosensitive sheets. When the length of a side flap is longer than the total thickness of the photosensitive sheets, the excess length portion is preferably turned. However, the most preferable structure is that both the upper panel and the lower panel are provided with a side flap having approximately the same length as the total thickness of the photosensitive sheets to be packaged, respectively.

The protective sheet of the invention is formed of one sheet, and each side flap is also divided by a crease line, a perforation line or the like. The protective sheet may be made of paper, such as cardboard. However, suitable protective sheets are made of a plastic resin, because it generates little dust by friction. It is necessary to have a suitable rigidity so as not to bend to any significant extent when the packaged photosensitive sheets are picked up. Preferable protective sheets include polypropylene resin sheet, polyethylene resin sheet, polyvinyl chloride resin sheet and polystyrene resin sheet. The suitable thickness of the protective sheet is, in the case of paper, about 0.2 to 1.0 mm, preferably about 0.4 to 0.8 mm, and in the case of plastic sheet, about 0.1 to 1.5 mm, preferably about 0.2 to 0.6 mm.

When photosensitive sheets are packaged, they are turned up and placed between the upper panel and the bottom panel. Then, each side flap is joined. The joining means may be selected from known ones, such as the use of adhesive, the use of adhesive tape and the use of heat sealing. Among them, the use of adhesive tape is the most preferable in view of suitable adhesive strength and workability.

The photosensitive sheets covered by the protective sheet is placed in a light-shielding bag, and supplied to the user.

The protective sheet of the invention is formed of one sheet, and the preparation process may be fundamentally identical with the conventional process to prepare the U-shaped pad of FIG. 10. Therefore, the increase in cost is the material cost alone increased by the incorporation of the side flaps. The protective sheet tightly holds photosensitive sheets, and increases the physical strength of the packaged article. Therefore, the handling of the packaged article is easy.

EXAMPLES

Figure 2:
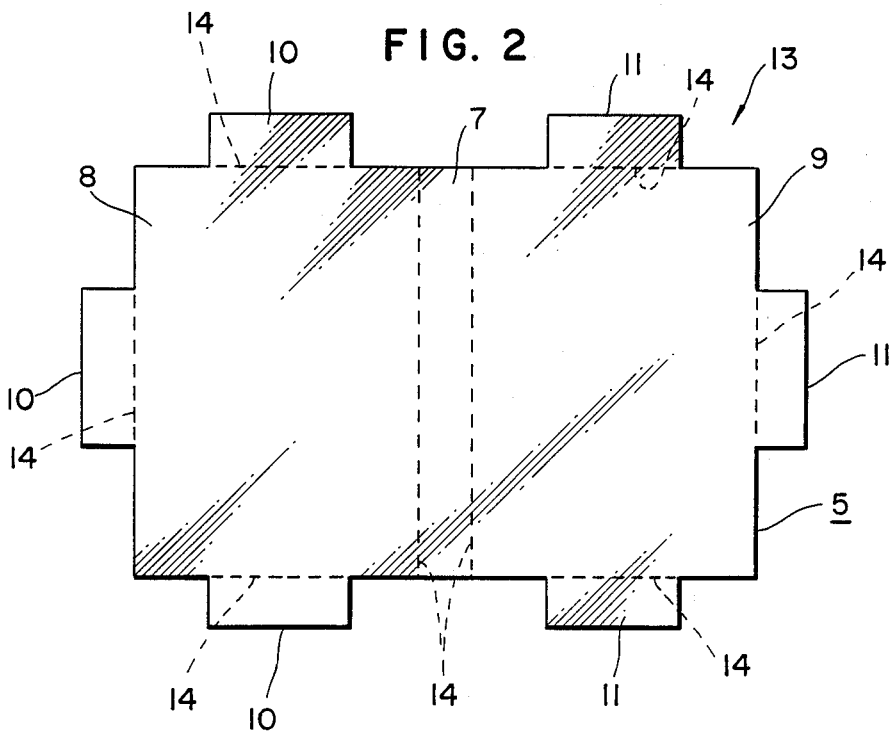
FIG. 2 is a plan view indicating the developed state thereof.
Figure 3:
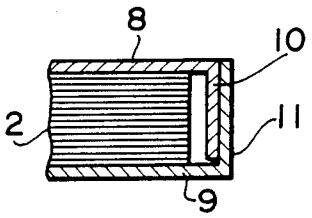
FIG. 3 is a partially sectional view indicating the constructed state thereof around a side flap portion.

An example of the protective sheet is illustrated in FIGS. 1 to 3. In FIG. 1, protective sheet 5 is U-shaped, and composed of back panel 7 and upper panel 8 and bottom panel 9 covering almost whole surfaces of photosensitive sheets 2. Each side flap 10 is formed around the center of three free sides of upper panel 8. As shown in FIG. 3, the side flaps are turned down, and their edges almost reach bottom panel 9. On the other hand, each side flap 11 is also formed at the corresponding position of three free sides of bottom panel 9, and are turned up. Each side flap 11 is superposed on the outside of side flap 10 of upper panel 8, and the edge of each side flap 11 almost reaches upper panel 8. The protective sheet 5 is a polypropylene resin sheet 0.2 mm in thickness, and respective both side flaps 10, 11 are joined by double face adhesive tape. Photosensitive sheets 2 are enveloped by upper panel 8, bottom panel 9, back panel 7 and three pairs of side flaps 10, 11, and placed in a packaging bag 3 in this state.

The unfolded state of the protective sheet 5 is known in FIG. 2. As shown in the drawing, upper panel 8 and bottom panel 9 are disposed on both sides of back panel 7. The protective sheet 5 is formed of one sheet, and respective panels 7, 8, 9 and side flaps 10, 11 are divided by a crease lines 14.

FIGS. 4 to 9 illustrate respective structures of side flap portion of other examples.

Figure 4:
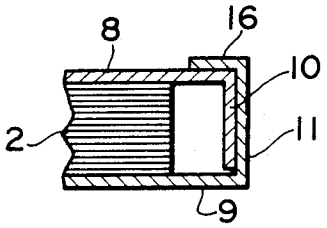
FIGS. 4 to 9 are partially sectional view indicating the constructed states around a side flap portion of some other protective sheets also embodying the invention.

In the example of FIG. 4, side flap 10 is turned down, and its edge almost reaches bottom panel 9. While, side flap 11 is longer than side flap 10, and the excess portion 16 of side flap 11 turned up is further turned and joined to the face of upper panel 8.

Figure 5:
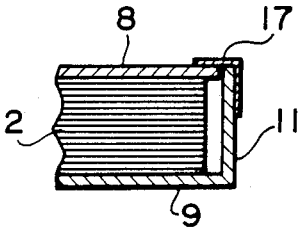

In the example of FIG. 5, only bottom panel 9 is provided with side flap 11. Side flap 11 is turned up, and its edge is joined by adhesive tape 17 to upper panel 8.

Figure 6:
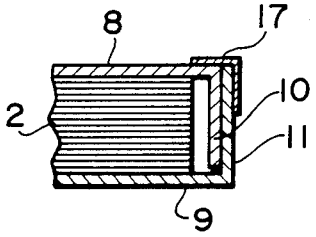

In the example of FIG. 6, side flaps 10, 11 are the same as described in FIG. 3, but they are joined by adhesive tape 17 instead of adhesive.

Figure 7:
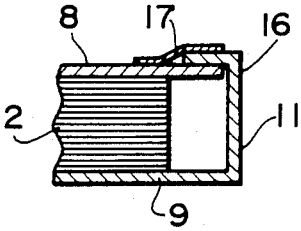

In the example of FIG. 7, only bottom panel 9 is provided with side flap 11 which is longer than the stacked thickness of photosensitive sheets 2. Side flap 11 is turned up, and the excess portion 16 of side flap 11 is further turned and joined to the face of upper panel 8 by adhesive tape 17.

Figure 8:
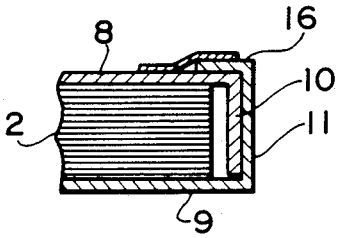

In the example of FIG. 8, side flaps 10, 11 are the same as described in FIG. 4, but they are fixed by joining the excess portion 16 to upper panel 8 by using adhesive tape 17.

Figure 9:
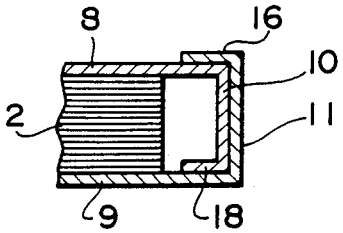

In the example of FIG. 9, both side flaps 10, 11 are longer than the stacked thickness of photosensitive sheets 2, and both excess portions 16, 18 are turned and joined by ultrasonic sealing.

I claim:

1. A protective sheet used for packaging photosensitive sheets which comprises a single polypropylene sheet having a thickness of 0.1 to 1.5 mm and having a back panel, an upper panel connected with the upper edge of the back panel and having three free edges and a bottom panel connected with the lower edge of the back panel and having three free edges, said upper panel and said bottom panel being provided with side flaps on each of the three free edges, said side flaps of said upper panel and said bottom panel being provided at the corresponding position to each other and being joined by adhesive tape to prevent the photosensitive sheets from slipping out.

2. The protective sheet of claim 1 wherein the side flaps of at least one of said upper panel and said bottom panel extend substantially the same distance as the distance from the upper edge to the lower edge of the back panel.

3. The protective sheet of claim 1 wherein the side flaps of both said upper panel and said bottom panel extend substantially the same distance as the distance from the upper edge to the lower edge of the back panel.

* * * * *